US008078080B2

(12) United States Patent
Sawada et al.

(10) Patent No.: US 8,078,080 B2
(45) Date of Patent: Dec. 13, 2011

(54) IMAGE FORMING APPARATUS

(75) Inventors: Masashi Sawada, Abiko (JP); Yoichi Furuyama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 347 days.

(21) Appl. No.: 12/476,433

(22) Filed: Jun. 2, 2009

(65) Prior Publication Data

US 2009/0311000 A1 Dec. 17, 2009

(30) Foreign Application Priority Data

Jun. 11, 2008 (JP) ..... 2008-153344

(51) Int. Cl.
*G03G 21/20* (2006.01)

(52) U.S. Cl. ..... 399/92

(58) Field of Classification Search ..... 399/92; 219/216, 469

See application file for complete search history.

(56) References Cited

FOREIGN PATENT DOCUMENTS

| | | | |
|---|---|---|---|
| JP | 10-10955 | A | 1/1998 |
| JP | 2003-195731 | A | 7/2003 |
| JP | 2006-113467 | A | 4/2006 |
| JP | 2006-317703 | A | 11/2006 |
| JP | 2007-304132 | A | 11/2007 |
| JP | 2008-116681 | A | 5/2008 |

*Primary Examiner* — David Gray
*Assistant Examiner* — Ruth Labombard
(74) *Attorney, Agent, or Firm* — Fitzpatrick, Cella, Harper & Scinto

(57) ABSTRACT

An image forming apparatus includes a heat source, a toner containing member containing toner, and an electric fan for generating air flow in an air flow path formed between the heat source and the toner containing member. In the image forming apparatus, a temperature of the heat source reaches a glass transition point of the toner. After the electric fan is changed from a driving state to a rest state, a phase transition member for absorbing heat is disposed in a heat transfer path, in which heat transfers, from the heat source to the toner containing member.

8 Claims, 9 Drawing Sheets

IMAGE FORMING APPARATUS

FIELD OF THE INVENTION AND RELATED ART

The present invention relates to an image forming apparatus of an electrophotographic type, particularly an image forming apparatus such as a copying machine, a printer, a facsimile machine, or a multi-function machine having a plurality of functions of these machines.

In recent years, the image forming apparatus of the electrophotographic type is required to achieve high productivity. Correspondingly, there is a tendency to lower a softening temperature of toner used for image formation.

Further, downsizing of the image forming apparatus is also required. Correspondingly, packing density of various devices is increased, so that there is a tendency to bring mounting positions of a developing device, a toner supply container, and a toner containing portion such as a toner feeding pipe for connecting these members closer to a fixing device as a heat source.

In such a background, a possibility that the toner in the toner containing portion is increased in temperature by heat of the fixing device to be softened has been increased.

In an image forming apparatus described in Japanese Laid-Open Patent Application (JP-A) 2006-113467, a heat insulating member is provided between the toner containing portion and the fixing device to block heat transfer from the fixing device. However, in such a constitution, the heat insulating member is required to have such a thickness that it can completely prevent temperature rise at the toner containing portion. Further, a space for mounting the heat insulating member is required to be sufficiently ensured. That is, the constitution cannot contribute to reduced size of the image forming apparatus and therefore it cannot be said that the constitution is a preferable solution.

In an apparatus described in JP-A Hei 10-10955, a fan for cooling the fixing device is provided, thus preventing the toner containing portion to increase in temperature during operation of the fixing device. Further, in this apparatus, even when an electric power switch of the apparatus is turned off, the temperature rise of the toner containing portion is prevented by actuating a cooling fan for a certain time. However, in such a constitution, electric power for operating the fan for the certain time is needed, so that the constitution is also not the preferable solution.

In an apparatus described in JP-A 2006-317703, not only a fan for cooling the developing device but also a cool storage material for cooling the developing device are provided. Specifically, the cool storage material is mounted to the outside of the apparatus and is connected with the developing device through a good heat-conductive member to cool the developing device by the cool storage material in the case where the cooling by the fan is insufficient.

Thus, in the apparatus described in JP-A 2006-317703, even when the fan is stopped by turning off the electric power switch, it is possible to suppress the temperature rise of the toner containing portion by using the cool storage material but the apparatus involves the following problem.

For example, in the case where the temperature of the cool storage material has already reached a molting temperature during the operation of the apparatus, when an operation of the fan is forcedly stopped by the turning off of the electric power switch, the developing device cannot be sufficiently cooled by the cool storage material, thus causing a problem that the toner is softened. As a result, the softened toner causes an occurrence of image defect or improper toner feeding.

Further, there is room for improvement in terms of space saving since the space for mounting the cool storage material is required to be provided to the outside of the apparatus. Further, there is also room for improvement in terms of cost since the good heat-conductive member can be expensive.

SUMMARY OF THE INVENTION

A principal object of the present invention is to provide an image forming apparatus capable of appropriately suppressing temperature rise of a toner containing portion by a phase transition material when a fan is at rest.

According to an aspect of the present invention, there is provided an image forming apparatus comprising:

a toner image forming device configured to form a toner image on a sheet using toner, the toner image forming device having a toner containing portion configured to contain the toner;

an image heating device configured to heat the toner image on the sheet;

a fan configured to flow air in an air flow path between the toner containing portion and the image heating device; and a phase transition material, disposed at a position closer to the toner containing portion than the image heating device with respect to the air flow path, configured to cool the toner containing portion with a phase transition from a solid phase to a liquid phase when the fan is stopped.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the image forming apparatus according to the present invention will be described with reference to the drawings.

Embodiment 1

Figure 1:
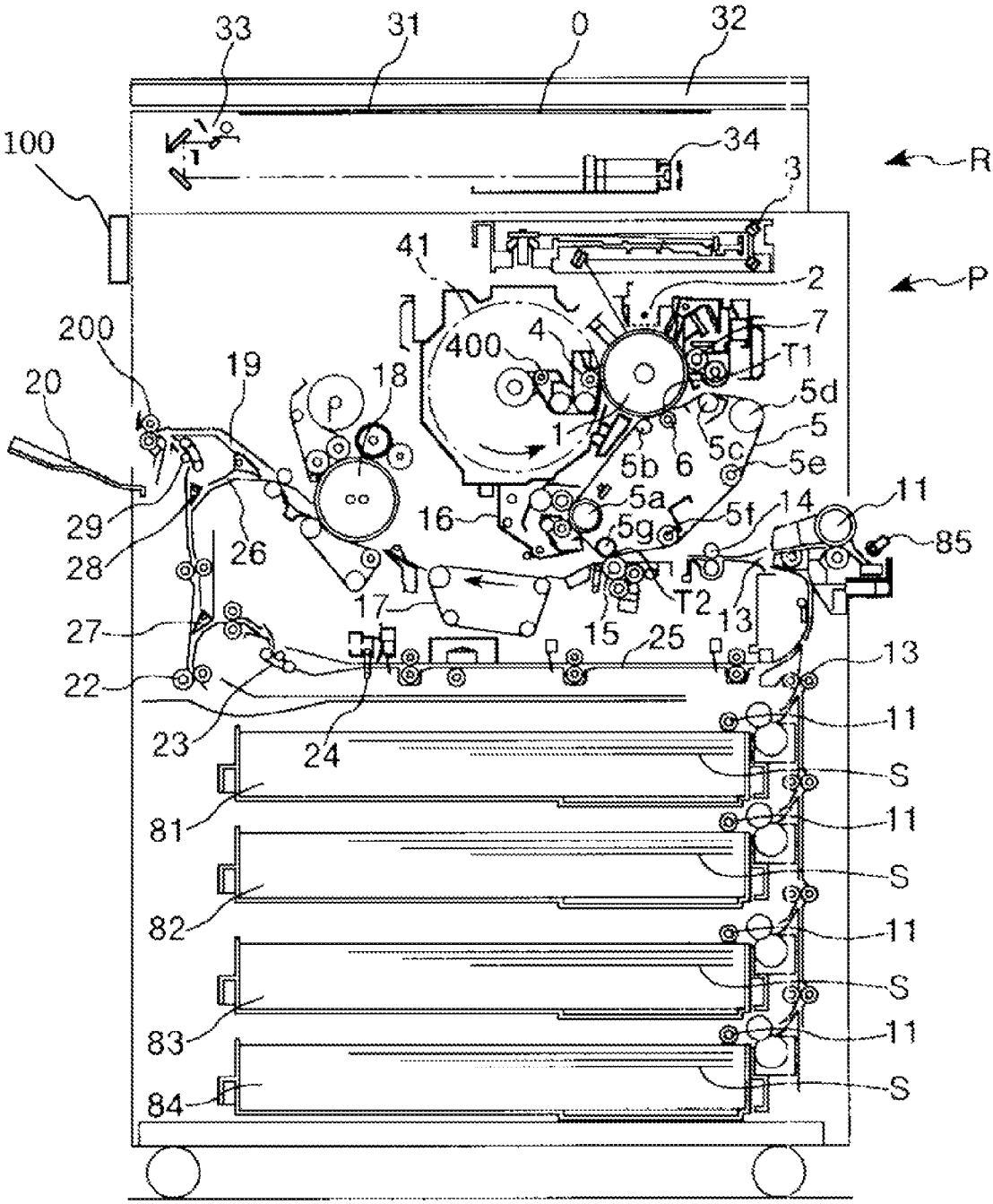
FIG. 1 is a schematic sectional view of the image forming apparatus according to the present invention in Embodiment 1.

FIG. 1 is a schematic sectional view showing an embodiment of the image forming apparatus to which the present invention is applied. This image forming apparatus is an electrophotographic full-color image forming apparatus and includes a digital color image reader portion R as an upper portion and a digital color image printer portion P as a lower portion. Further, to the image forming apparatus connected to a commercial power source, a main switch (hard switch) 100 for switching between an operation state and a rest state of the apparatus is provided. When this main switch 100 is turned off by an operator, electric power supply to various devices in the image forming apparatus is stopped in interrelation with the turning-off of the main switch 100. That is, a cooling fan 50 described later is also, when the main switch 100 is turned off by the operator, stopped correspondingly. Further, to the image forming apparatus of this embodiment, an operating portion for setting printing conditions (the number of print sheets, a size or type of sheets used, and the like) by the operator is provided. To the operating portion, an auxiliary switch (soft switch) for shifting the state of the image forming apparatus to a power-saving state is provided.

In this embodiment, to the reader portion R, an original supporting platen glass 31 and openable original cover 32 are provided. On the glass 31, a color original O is placed in accordance with a predetermined placing standard with a downward image surface and is covered with the original cover 32, thus being set.

It is also possible to employ such a constitution that a sheet-like original is automatically fed onto the glass by replacing the original cover 32 with an automatic original document feeding device (ADF, RDF).

Along a lower surface of the glass 31, a movable optical system 33 is moved and driven. By this movable optical system 33, the downward image surface of the original O on the glass 31 is optically scanned. The original scanning light provides an image on a CCD 34 as a photoelectric conversion element (solid-state image pickup device) and is subjected to color-separation reading of three primary colors of R (red), G (green) and B (blue).

The respective read signals for RGB (not shown) are inputted into an image processing portion.

The printer portion P functioning as a toner image forming device for forming a toner image on the sheet is configured as an electrophotographic image forming mechanism including a one drum and rotary development constitution and an intermediary transfer constitution.

A schematic operation of this printer portion is as follows.

A drum-like electrophotographic photosensitive member as an image bearing member (hereinafter referred to as a "photosensitive drum") 1 is electrically charged uniformly by a charging device (charging means) 2 and is then subjected to imagewise exposure to light by a laser scanner 3, so that an exposure image (electrostatic image) is formed on the photosensitive drum 1. The electrostatic image is supplied with toner from a developing means to be developed into a visible image (toner image).

In this embodiment, the developing means is a rotary developing apparatus to which a plurality of developing devices 4 is provided to a developing rotary 41. In FIG. 1, a state in which one developing device 4 is provided to the developing rotary 41 is shown but five developing devices 4 containing developers (toners) of colors of yellow, magenta, cyan, black, and clear (transparent), respectively, are actually mounted. The respective developing devices have the same constitution except for the toners contained. Each developer may be one component developer (toner) or two component developer containing toner and a carrier.

In the case of forming a color image, by the rotation of the developing rotary 41, a desired developing device is located at a developing position which is a portion opposite to the photosensitive member. When the electrostatic image formed on the photosensitive member is completely developed by the developing device located at the developing position, the developing rotary 41 is rotated to position a subsequent developing device at the developing position. Such a step is repeated for each of the developing devices for yellow, cyan, magenta, and black, so that a full-color toner image is formed on an intermediary transfer belt 5 described later.

When a clear image is formed together with the color image, by repeating the above-described step five times, an image consisting of the full-color image and the clear image is formed on the intermediary transfer belt 5 in a superposition manner.

At an upper portion of the developing rotary 41, a hopper portion 700 is provided. To the hopper portion 700, a mounting portion for mounting a toner supply container (toner cartridge) 70 detachably mountable to the image forming apparatus and a toner feeding portion 71 for supplying the toner discharged from the toner supply container 70 mounted to the mounting portion toward the respective developing devices 4 are provided. The toner supply container, the mounting portion, and the toner feeding portion are provided are provided for each of the color toners and thus in this embodiment, five toner supply containers, five mounting portions, and five toner feeding portions are provided in total.

The respective color toners on the photosensitive drum 1 are repetitively primary-transferred onto the intermediary transfer member (hereinafter referred to as a "belt") 5 for each of the colors, thus being superposed on the belt 7.

With predetermined control timing, a sheet feeding roller 11 for a preselected sheet feeding portion from a plurality of sheet feeding portions including first to fourth sheet feeding cassettes 81 to 84 and a manually feeding multi-tray 85 is driven. As a result, one sheet of a recording material S as sheets accommodated in an associated sheet feeding portion is separated and fed to a registration roller 14 through a sheet path 13.

The registration roller 14 is configured to effect correction of oblique movement of the recording material S and control of timing of secondary transfer of the toner image from the belt 5 onto the recording material S and receives and once steps an end of the recording materials fed from the sheet feeding portion side.

A secondary transfer roller 15 is detachably controlled by a pressurization control mechanism (not shown) so as to switch between a first state (condition) in which the secondary transfer roller 15 presses the belt 5 against a roller 5*g*, as an opposite roller, of a plurality of rollers 5*a* to 5*g* for the belt 5 and a second state (condition) in which the secondary transfer roller 15 is separated from an outer surface of the belt 5.

The secondary transfer roller 15 is normally held in the second state, in which it is separated from the outer surface of the belt 5, by switching. By the switching to the first state, a secondary transfer nip (portion) T2 is created between the secondary transfer roller 15 and the belt 5.

The state of the secondary transfer roller 15 is switched to the first state with predetermined control timing. Further, the recording material S once stopped at the position of the registration roller 14 is further fed from the registration roller 14 with predetermined control timing and is guided into the secondary transfer nip T2 between the belt 5 and the secondary transfer roller 15 placed in the first state by the switching.

The recording material S is nip-conveyed in the secondary transfer nip T2. During the operation, a predetermined secondary transfer voltage is applied to the secondary transfer roller 15 to collectively transfer the toner images of the plurality of colors onto the recording material S electrostatically, so that an unfixed toner image is formed (transferred) on the recording material S.

The toner remaining on the photosensitive drum 1 is removed from a photosensitive surface by the cleaning device 7, so that the photosensitive drum 1 is subjected to subsequent image formation.

Secondary transfer residual toner remaining on the surface of the belt 5 without being transferred onto the recording material S is removed from the belt surface by a belt cleaning device 16. The belt 5 cleaned by the belt cleaning device 16 is repetitively subjected to image formation.

The belt cleaning device 16 is normally held in a state in which it is separated from the outer surface of the belt 5. When the secondary transfer of the toner images from the belt 5 onto the recording material S is performed in the secondary transfer nip T2, the state of the belt cleaning device 16 is switched to a state, in which it contacts the outer surface of the belt 5, with predetermined control timing.

The recording material S coming out of the secondary transfer nip T2 is separated from the surface of the belt 5 and is conveyed to the fixing device 18 as a fixing means by a conveying belt unit 17.

The unfixed toner image is fixed on the recording material S by heat from a heat source and pressure exerted by the fixing device 18 functioning as an image heating apparatus. The recording material S coming out of the fixing device 18 passes through a sheet path 18, thus being discharged on a sheet discharge tray 20 by a sheet discharge roller 200.

A switching flapper 26, sheet conveying paths 22 to 29, and the like to be used during transfer and fixation of the image on the sheet (recording material) S again are used in the case where a both side image forming mode or a multiple image forming mode is selected.

An image forming operation in the both side image forming mode or the multiple image forming mode is well known by the person skilled in the art, thus being omitted from detailed description.

Next, with reference to FIGS. 2(*a*) and 2(*b*) and FIG. 3, a structure of the toner feeding portion and then nationhood thereof will be described.

Figure 2:
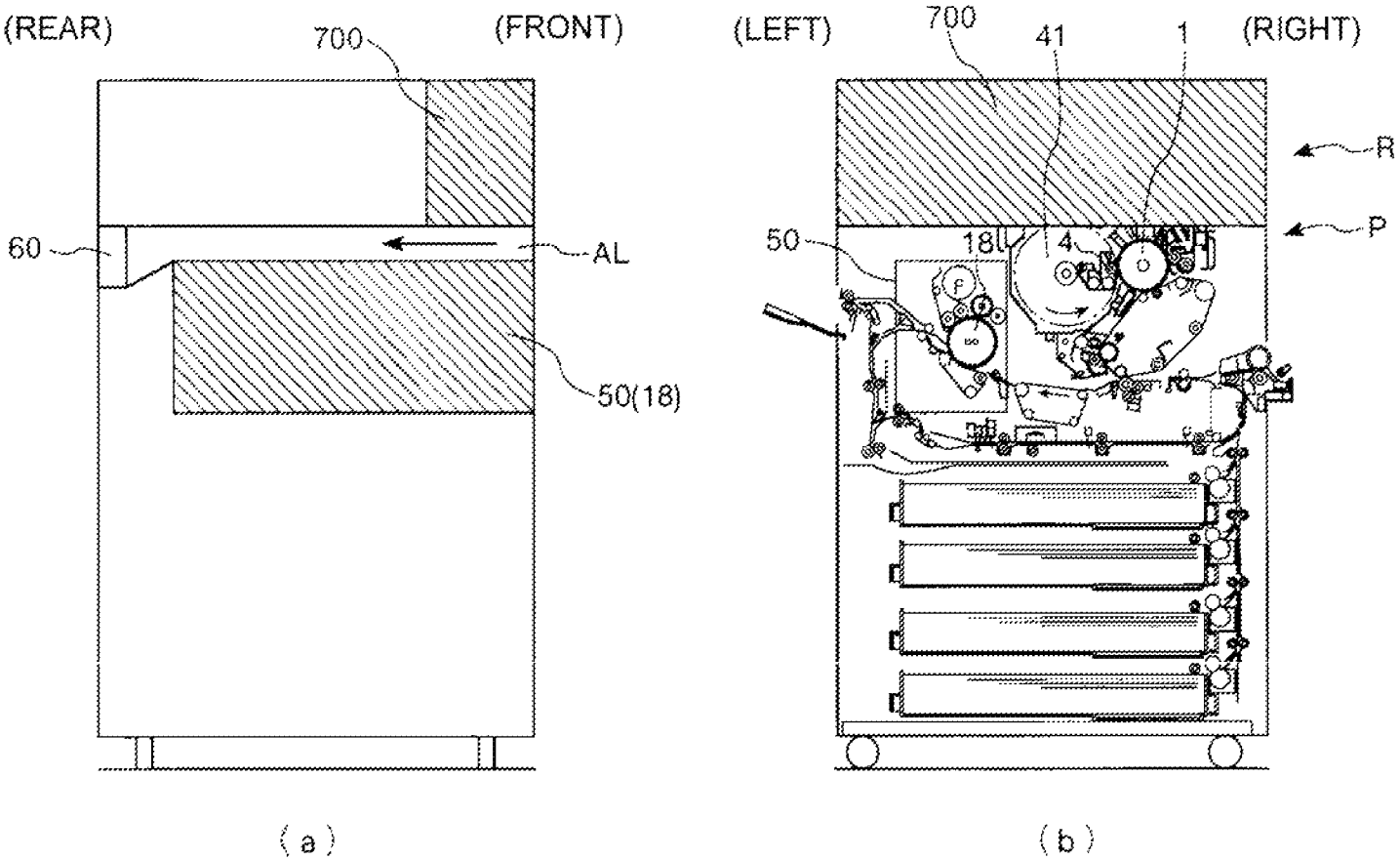
FIG. 2(*a*) is a sectional left side view showing arrangement of a hopper, a fixing device, and a cooling fan, and FIG. 2(*b*) is a sectional front view showing arrangement of the hopper and the fixing device.

FIG. 2(*a*) is a schematic view of the image forming apparatus shown in FIG. 1 as seen from a left side of the image forming apparatus and FIG. 2(*b*) is a schematic view of the image forming apparatus as seen from a front side of the image forming apparatus similarly as in FIG. 1.

The hopper portion 700 and the fixing device 18 including a heat source 50 is disposed as shown in FIGS. 2(*a*) and 2(*b*). That is, the hopper portion 700 is located above the developing rotary 41 and the fixing device 18 (i.e., the heat source 50) and is located on a front side (on an operator side or a right-hand side in FIG. 2(*a*)) with respect to a width direction of the image forming apparatus (an axial direction of the photosensitive drum 1). On a rear side of the image forming apparatus (a left-hand side in FIG. 2(*a*)), an electric fan 60 as a cooling fan is disposed.

On the other hand, the fixing device 18 is adjacent to a side of the developing rotary 41 and is extended and disposed in the width direction of the image forming apparatus.

Figure 3:
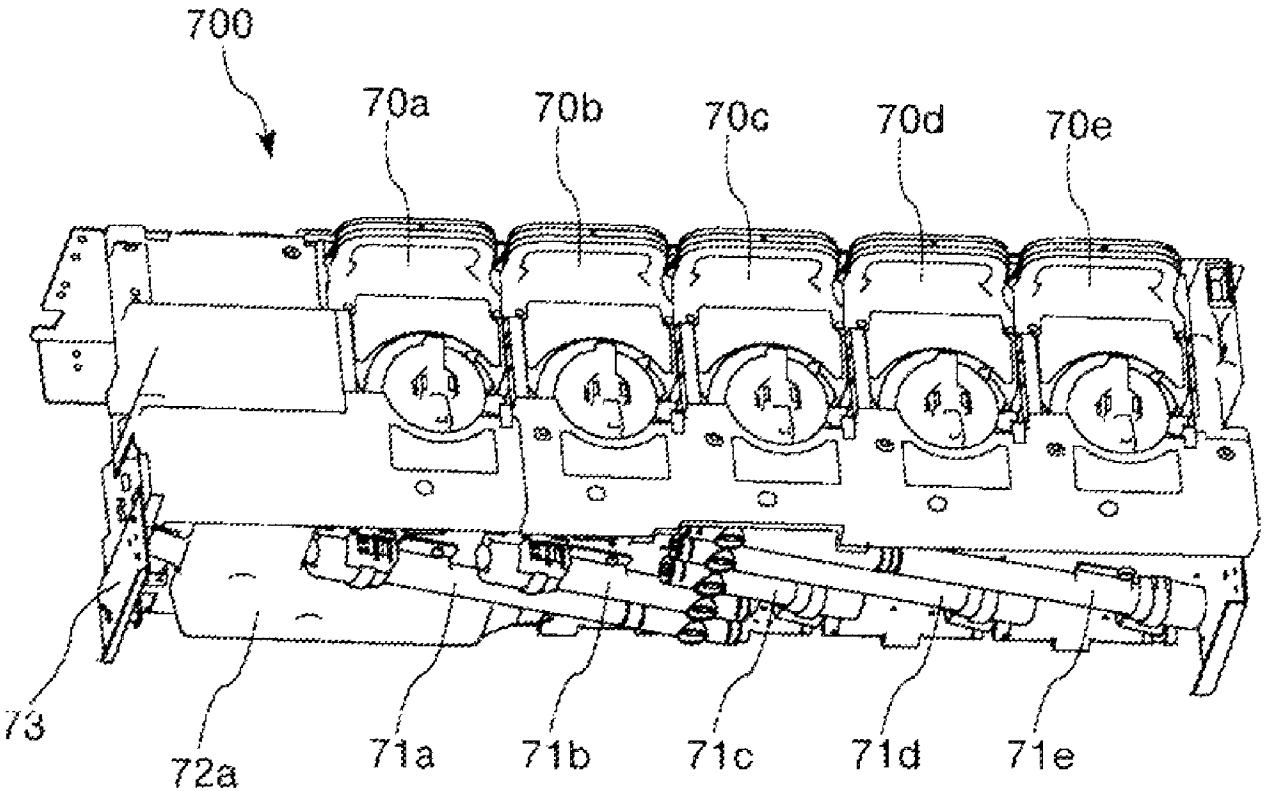
FIG. 3 is a schematic perspective view of the hopper.

As shown in FIG. 3, in this embodiment, the respective color toners corresponding to the five developing devices 4 and supplied to the developing rotary 41 through the toner feeding portions 71 (71*a* to 71*e*) functioning as the toner containing portion. That is, the hopper portion 70 includes a hopper frame 73 by which the toner cartridges 70 (70*a* to 70*e*) are held. Therefore, the toners in the respective toner cartridges are supplied to the developing rotary 41 through the toner feeding portions 71 (71*a* to 71*e*) disposed below the hopper frame 73.

In the above constitution, as shown in FIG. 2(*a*), an air (flow) path AL is formed between the hopper portion 700 and the fixing device 18 and the electric fan 60 is disposed on the rear side of the image forming apparatus with respect to the width direction of the image forming apparatus, i.e., on a side opposite from the hopper portion 700 side.

The electric fan 60 generates air flow in the air path AL formed between the heat source 50 (the fixing device 18) and the toner feeding portion 71. In this embodiment, as the electric fan 60, an exhaust fan is used but a suction fan may also be used if the suction fan is capable of generating the air flow in the air path AL.

In the state in which the main switch 100 is turned on, the electric fan 60 is actuated, so that a forced air flow for cooling is formed in the air path AL between the fixing device 18 and the hopper portion 700 with respect to a direction of an arrow indicated in FIG. 2(*a*). By this forced air flow, in the on state of the main switch 100, the temperature in the apparatus is suppressed at a level not more than a predetermined temperature. Therefore, the hopper plate 700 (the toner feeding portion 71) is kept in a relatively low temperature state and the phase transition material 72*a* is kept in a solid phase state.

Figure 4:
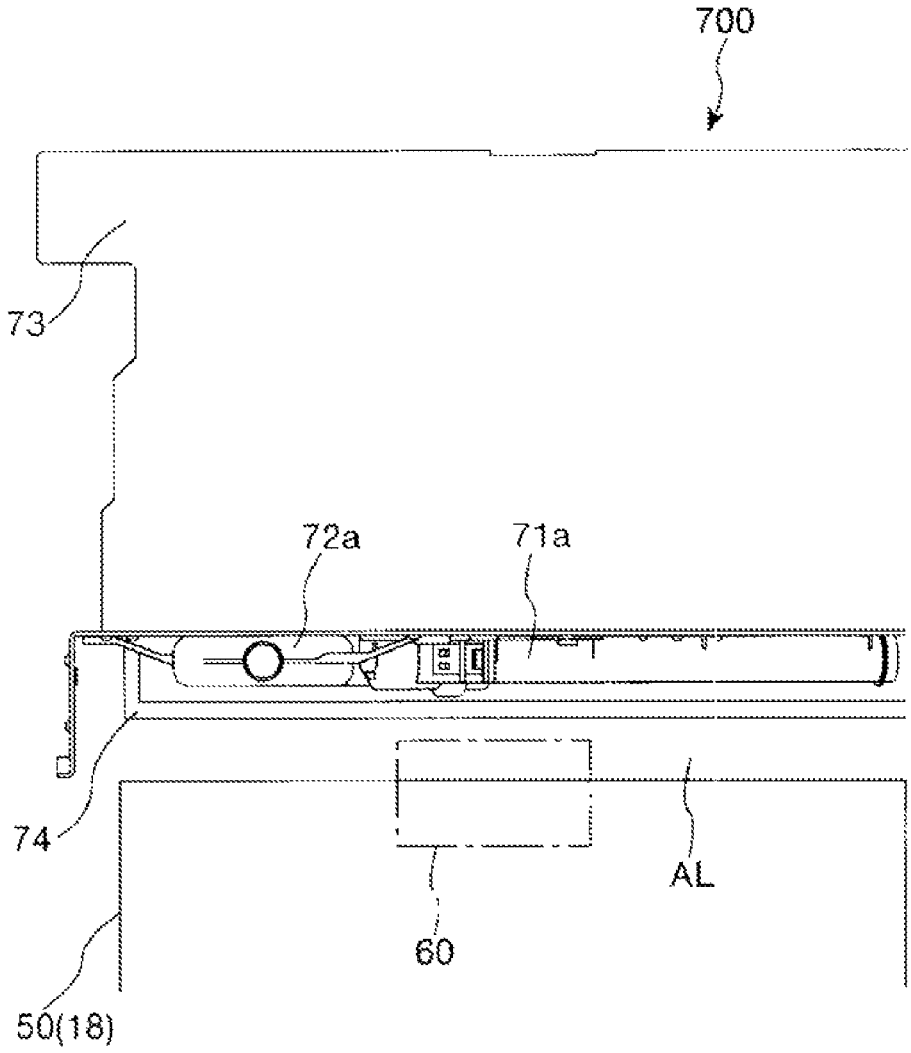
FIG. 4 is a sectional front view of the hopper.

In this embodiment, as shown in FIG. 4, a heat insulating cover 74 is disposed between the fixing device 18 and the toner feeding portions 71 (71*a* to 71*e*) mounted to a lower portion of the hopper frame 73.

Therefore, the heat insulating cover 74 forms the air path AL between it and the fixing device 18, thus having a guide function (a duct function) of forming the forced air flow for cooling and a heat insulating function of suppressing conduction of heat generated from the fixing device 18 as the heat source 50 to the toner feeding portions 71 (71*a* to 71*e*).

Here, when the operator erroneously turns the main switch 100 off during the image formation in the on state of the main switch 100 of the image forming apparatus 100 placed in the state of being connected to the commercial electric power source, the following problem occurs. Incidentally, a similar problem is also caused to occur by erroneous pulling of an electric cord establishing a connection relationship with an electric connector by the electric connector for connecting the image forming apparatus to the commercial electric power supply. Further, the similar problem is also caused by a power failure due to lightning. Thus, the problem occurs when the image forming apparatus is in operation, i.e., when electric power supply to the fan 60 placed in a state in which the fan 60 performs a cooling process with the air flow is suddenly interrupted.

That is, regardless of a high temperature state of the fixing device 18 by the operation of the fixing device 18, the electric power supply is stopped by the turning-off of the main switch 100, thus stopping the electric fan 60. Then, heat is transferred from the fixing device 18 as the heat source to the toner feeding portion 71 constituting the toner containing portion, thus increasing the temperature of the toner feeding portion 71.

That is, according to the present invention, the toner feeding portion 71 as the toner containing portion is disposed over the fixing device 18 as the heat source 50. When the main switch 100 is turned off by the lightning or the like to stop the cooling fan (electric fan) 60 in a state in which the inside of the apparatus is sufficiently warmed during operation, there is a possibility that the temperature of the toner feeding portion 71*a* is increased up to about 55° C. which is a glass transition temperature of the toner.

Figure 5:
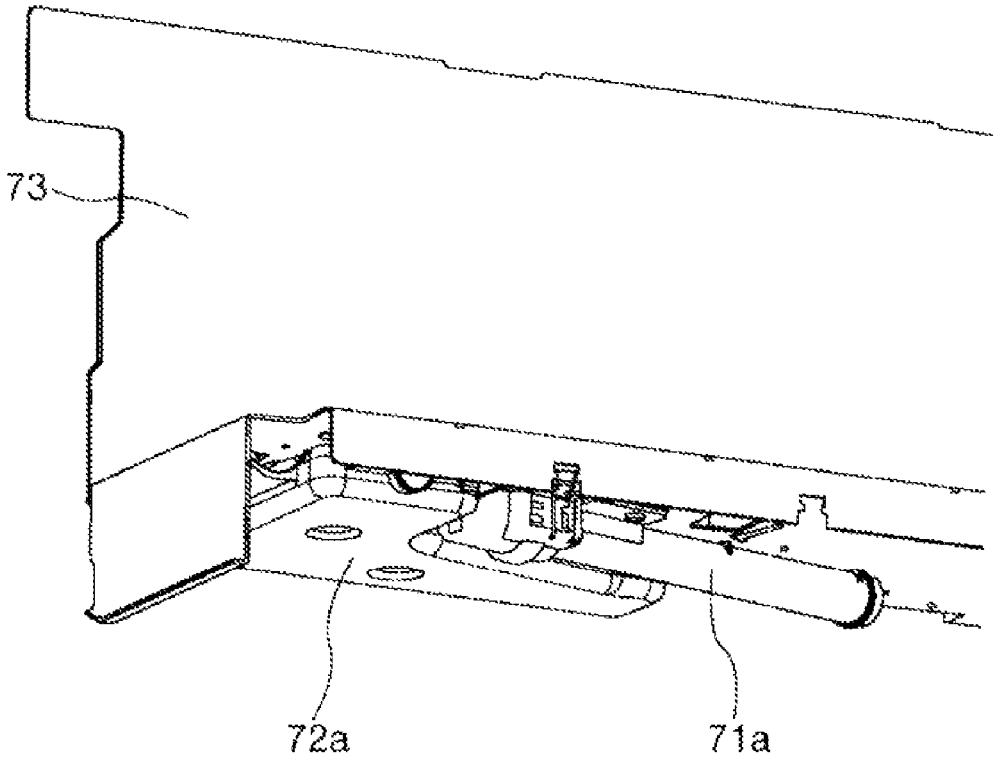
FIG. 5 is a perspective view of a heat-absorbing member in Embodiment 1.

As is understood from FIGS. 4 and 5, the heat transfer from the fixing device 18 to the toner feeding portion 71*a* is principally performed through the metal-mode frame 73, present in a heat transfer path, as a heat transfer medium. For that reason, a heat-absorbing member 72*a* is attached to the lower surface side (the rear surface side) of the frame 73. Depending on the heat transfer path, the heat transfer medium to which the heat-absorbing member 72*a* is attached may desirably be attached to a material having a high thermal conductivity such as a metal member from the viewpoint of a heat-absorbing efficiency.

Figure 6:
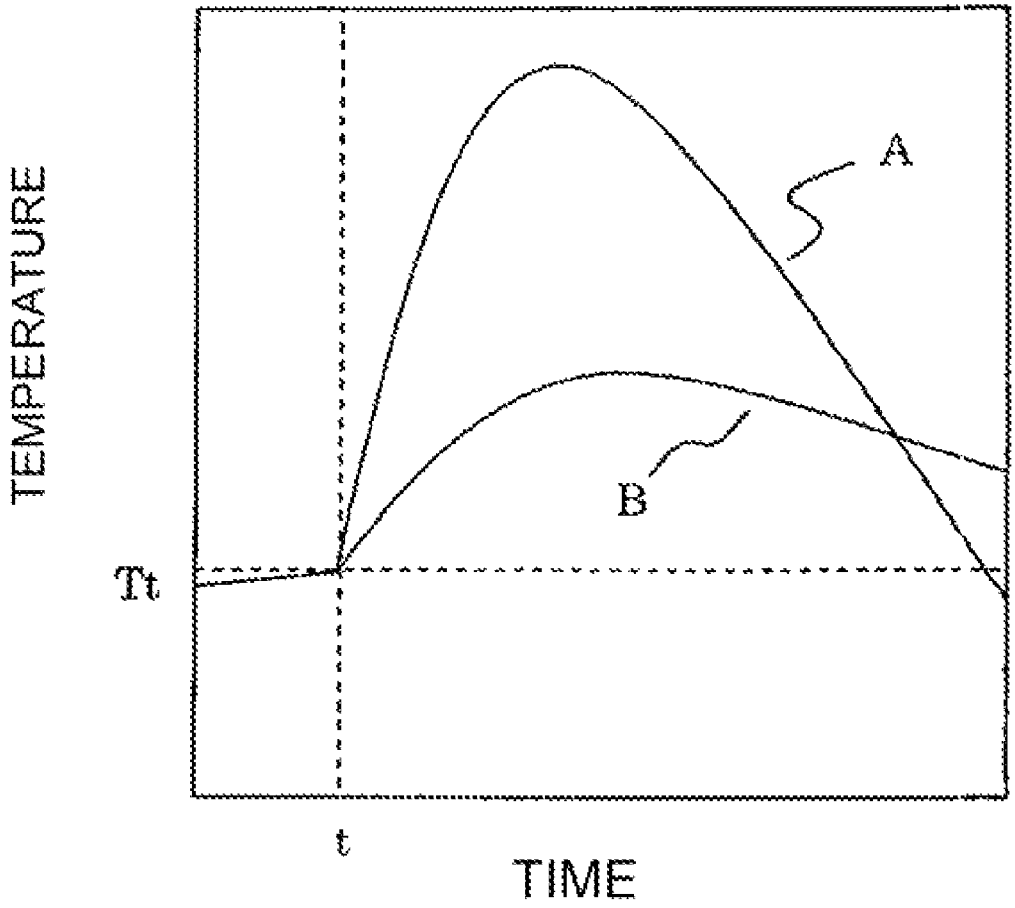
FIG. 6 is a graph showing a temperature change with time of a toner feeding pipe in Embodiment 1.

FIG. 6 is a graph showing a temperature change with time of the toner feeding portion 71*a*.

In the on state of the main switch 100, i.e., in the driven state of the electric fan 60, the image forming processing was continuously performed for 5 hours and then the main switch 100 was turned off at a time t to stop the drive of the electric fan 60. A temperature Tt of the toner feeding portion 71*a* at the time t is about 38° C. which is a reachable maximum temperature of the toner feeding portion 71*a* in the on state of the main switch 100.

According to this embodiment, as described above, the phase transition material as the heat-absorbing member 72*a* for absorbing heat is disposed in the heat transfer path. That is, in this embodiment, latent heat of fusion when the phase transition material as the heat-absorbing member 72*a* is changed from the solid phase state to a liquid phase state in utilized. According to this embodiment, as shown in FIGS. 4 and 5, the phase transition material 72*a* is disposed on the lower surface (rear surface) side of the hopper frame 73 to which the toner feeding portion 71*a* is fixed. Incidentally, as in this embodiment, such a constitution that the phase transition material is not exposed to cooling air passing through the air path AL by providing the heat insulating cover 74 between the phase transition material and the air plate AL is not employed but a constitution in which such a heat insulating cover is omitted may also be employed. In this case, the phase transition material is configured to be exposed to the cooling air flowing through the air path AL, so that, similarly as in this embodiment, the phase transition material can be kept in the solid phase state during the operation of the image forming apparatus.

The phase transition material 72*a* is a material which is placed in the solid phase state at the reachable maximum temperature of the toner feeding portion 71*a* in the on state of the main switch 100, i.e., at a temperature not more than the temperature Tt and which is placed in the liquid phase state at the glass transition point (temperature) of the toner. In other words, the phase transition material 72*a* is kept in the solid phase state when the fan is actuated. On the other hand, when the fan is stopped and is increased in temperature by the heat from the fixing device, the phase transition material 72*a* is changed from the solid phase state to the liquid phase state.

That is, a phase transition (change) temperature of the phase transition material is less than the reachable maximum temperature of the member, in the driven state of the electric fan 60, on which the phase transition material is disposed and is not more than the glass transition temperature of the toner.

As the phase transition material 72*a*, in this embodiment, a material principally comprising polyethylene glycol is used but is not limited thereto. It is also possible to use materials principally comprising sodium acetate, sodium sulfate, paraffin, or the like as the phase transition material.

The phase transition material 72*a* used in this embodiment is a polymeric material and therefore it is not difficult to clearly determine the temperature at which the phase transition material 72*a* is changed from the solid phase state to the liquid phase state, i.e., a melting temperature, so that a material having a freezing point of 40° C. measured as the phase transition temperature was used.

As described above, the heat transfer from the FD 18 to the toner feeding portion 71*a* is performed through the plurality of parts and the air but in this embodiment, the phase transition material 72*a* was disposed on the hopper frame 73 predominant in heat transfer in the heat transfer path from the fixing device 18 to the toner feeding portion 71*a*.

Incidentally, a phenomenon of a change from the liquid phase state to a gas phase state is also called the phase transfer (change) but in the case of isobaric change, a volume change is larger than that in the case of the change from the solid phase state to the liquid phase state, so that it is difficult to realize a container in which the phase transition material is sealed.

Therefore, in this embodiment, the material which had a relatively small volume change and was capable of meeting the change from the solid phase state to the liquid phase state was used as the phase transition material 72*a* and the phase transition material 72*a* was sealed in the container molded with a resin material.

The container for accommodating the phase transition material 72*a* is formed a box-like shape by blow molding of a frame-retarded resin material in this embodiment in order to safely use the flammable phase transition material 72*a* in a resultant product and in order to prevent the phase transition material 72*a* changed into a liquid during heat absorption by the phase transfer from leaking into the product. As another example, the container may also be molded into a container shape or processed into a bladder-like shape by using drawing of metal such as aluminum. Further, the container may desirably have a shape having a large flat surface portion in order to increase a close-contact area thereby to enhance the heat absorption efficiency.

The phase transition material 72*a* absorbs latent heat during the phase transfer from the solid phase state to the liquid phase state. By this action, even when the main switch 100 of the image forming apparatus is erroneously turned off forcedly by the operator during the image formation to stop the electric fan 60 correspondingly, it is possible to suppress the temperature rise of the toner feeding portion 71*a* caused by the heat transfer from the fixing device 18.

In FIG. 6, "A" represents a temperature change of the toner feeding portion 71*a* in the case where the phase transition material is not disposed and "B" represents a temperature change of the toner feeding portion 71*a* in the case where the phase transition material is disposed. The case where the phase transition material 72*a* is disposed provides a lower peak temperature of the toner feeding portion 71*a*. It is found that the heat-absorbing effect of the phase transition material 72*a* manifests itself as the difference in temperature change between the two toner feeding portions 71*a*.

The temperature of the toner feeding portion 71*a* is, after reaches the peak temperature, gradually decreased due to the temperature difference from room temperature. The phase transition material 72*a* is changed from the liquid phase state to the solid phase state when its temperature is less than the phase transition (change) temperature after heat dissipation. The phase transition material 72*a* repeats the heat absorption and the heat dissipation by repeating the change from the solid phase state to the liquid phase state and the change from the liquid phase state to the solid phase state. That is, the phase transition material possesses a reusable property.

An amount of the phase transition material 72*a* to be disposed is determined depending on an amount of suppression of temperature rise of the toner feeding portion (the toner containing portion) after the electric fan 60 is stopped.

As described above, according to the constitution of this embodiment, it is possible to sufficiently cool the toner containing portion by utilizing the phase transfer (change) of the phase transition material when the fan is stopped, while preventing the temperature rise of the phase transition material together with the toner containing portion by the fan so that the phase transition material does not cause the phase transfer to the liquid phase state when the apparatus is in operation. As a result, even in the case where a space in which the heat insulating member can achieve a sufficient temperature rise suppression effect cannot be ensured in the apparatus, the temperature rise of an object to be suppressed in temperature rise can be suppressed so that the temperature is not more than a predetermined temperature without driving the cooling fan after the main switch 100 is turned off.

Incidentally, in the image forming apparatus, a motor and an electronic element are used and temperatures of these members reach a temperature not less than the glass transition point of the toner in some cases. Therefore, the motor, the electronic element, and the like can constitute the heat source for the toner in the toner containing portion, so that the present invention can also be similarly applied to such cases.

The above description is made by taking the toner feeding portion 71 as an example for the toner containing portion but the toner containing portion as an object portion to be cooled is not limited to the toner feeding portion 71. For example, the toner containing portion disposed above the fixing device 18 as the heat source 50 may also be the developing device or the toner supply container (the toner cartridge) for supplying the toner to the developing device. In this case, similarly as in the above-described case, the heat insulating cover 74 is provided between such a device or container and the fixing device and further, the air path AL is formed between the fixing device and the heat insulating cover 74.

Embodiment 2

Next, Embodiment 2 will be described. In this embodiment, the general structure of the image forming apparatus is similar to that of the image forming apparatus in Embodiment 1, so that a similar constitution will be omitted from detailed description.

Figure 7:
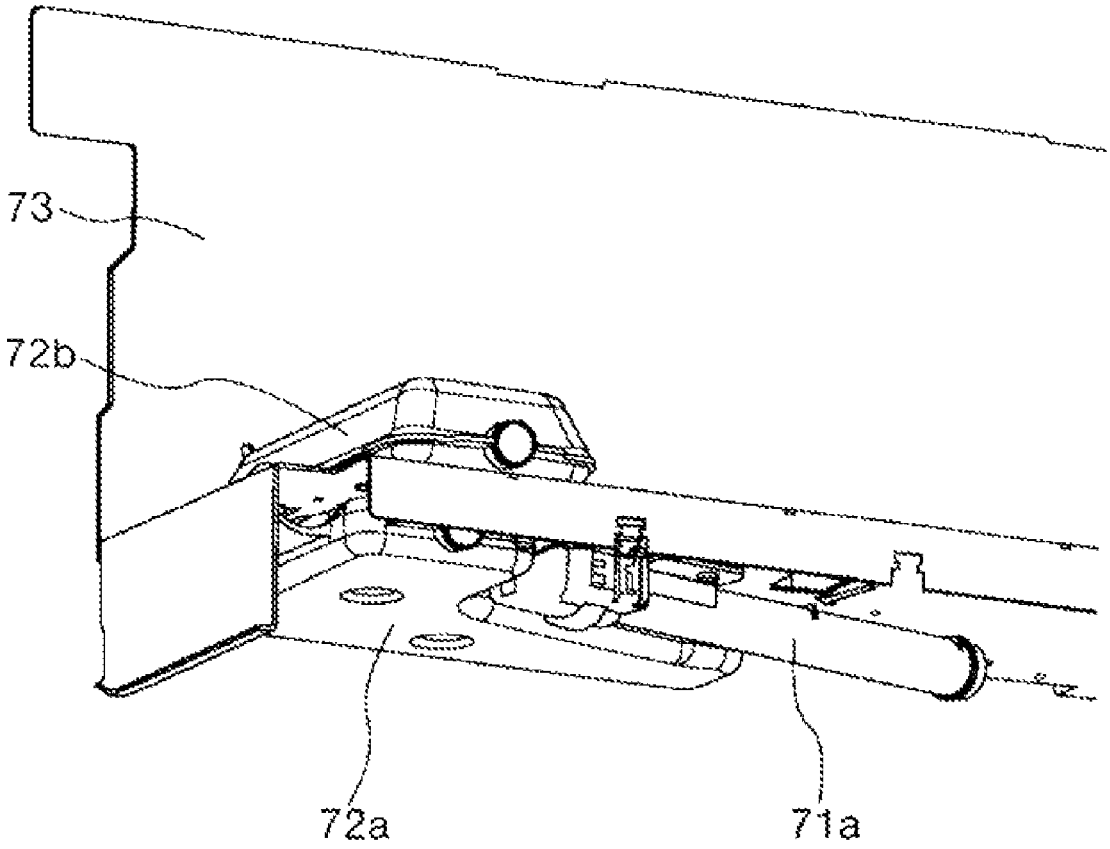
FIG. 7 is a perspective view of a heat-absorbing member in Embodiment 2.
Figure 8:
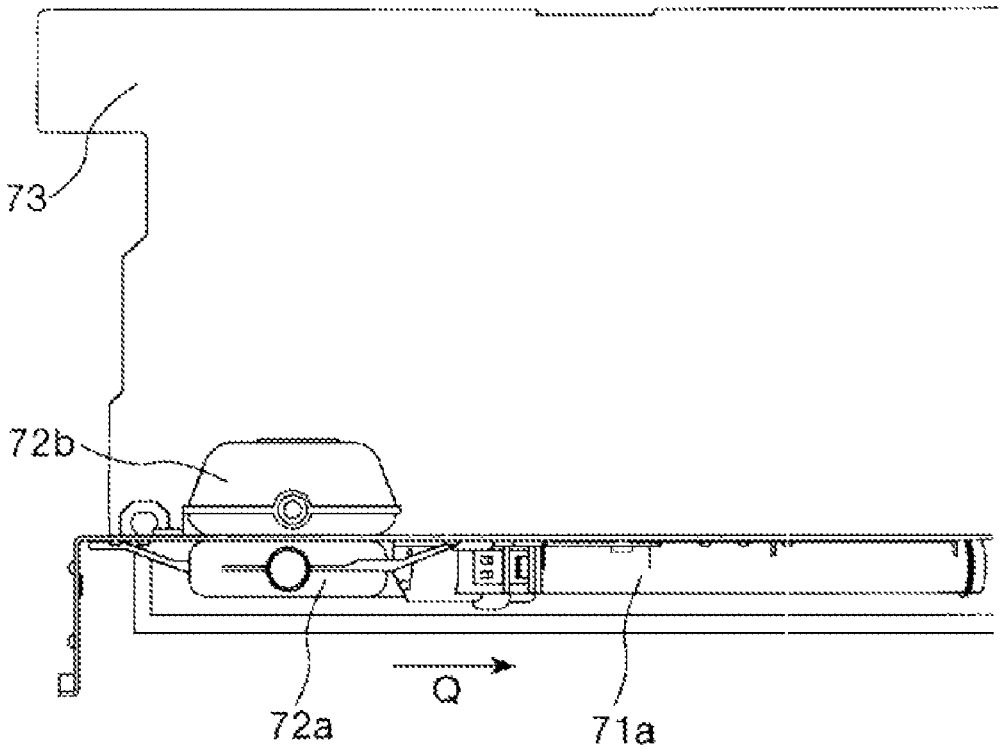
FIG. 8 is a front view of a hopper portion in Embodiment 2.

With reference to FIGS. 7 and 8, a structure of the toner feeding portion and the neighborhood thereof will be described.

Also in this embodiment, the disposition of the hopper portion 700 and the fixing device 18 have the same constitution as that in Embodiment 1 described with reference to FIGS. 2(*a*) and 2(*b*). That is, also in this embodiment, as is understood from FIGS. 2(*a*) and 2(*b*), the hopper portion 700 is located above the developing rotary 41 and the fixing device 18 and is located on a front side with respect to a width direction of the image forming apparatus (an axial direction of the photosensitive drum 1).

On the other hand, the fixing device 18 is adjacent to a side of the developing rotary 41 and is extended and disposed in the width direction of the image forming apparatus.

In this embodiment, with respect to the metal-made frame 73 as the heat transfer medium, heat-absorbing members 72*a* and 72*b* which are the same phase transition material as that in Embodiment 1 are attached to the frame 73 on a lower (rear) surface side and an upper (front) surface side, respectively.

That is, in this embodiment, the heat transfer from the FD 18 as the heat source to the toner feeding portion 71*a* as the object portion to be cooled is, as described above, performed through the frame 73 as the heat transfer medium by the heat conduction. When the heat transfer in the direction of an arrow Q indicated in FIG. 8 is considered, by attaching the heat-absorbing member to the front and rear sides of the frame, a contact area of the heat-absorbing member is doubled in the heat transfer path to enhance the heat absorption efficiency.

Figure 9:
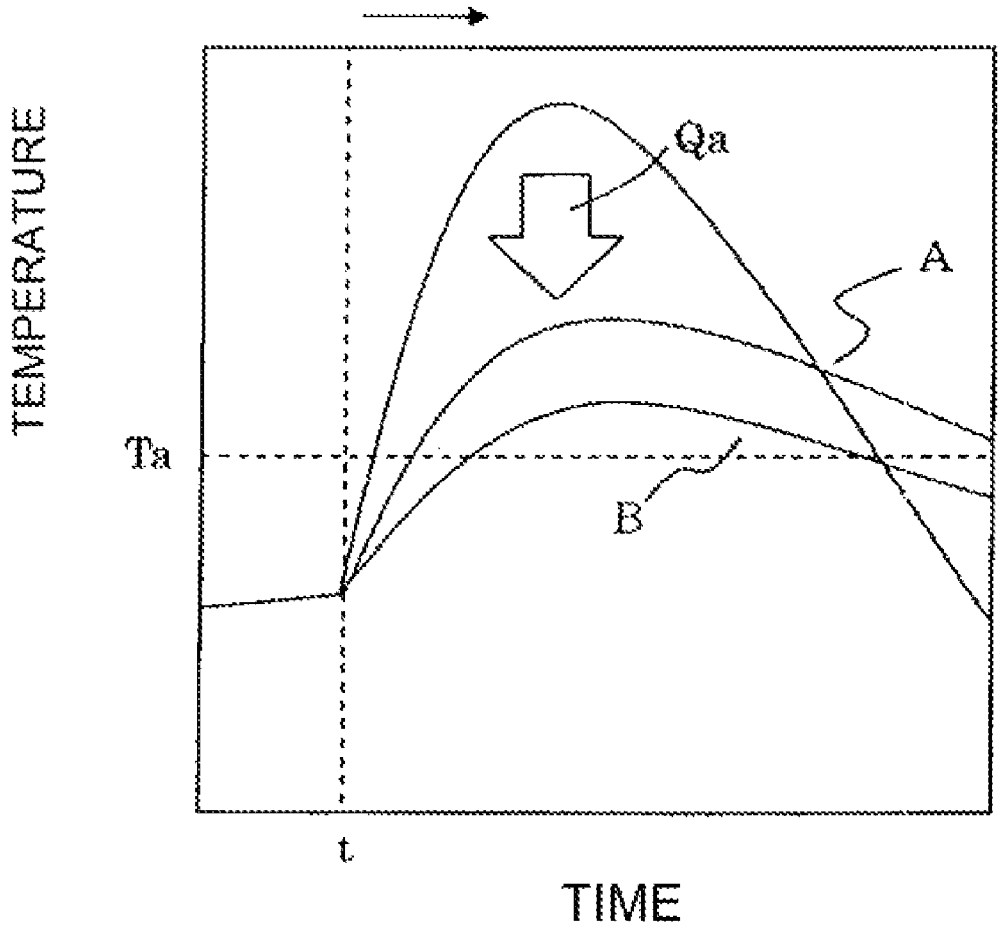
FIG. 9 is a graph showing a temperature change with time of a toner feeding pipe in Embodiment 2.

The temperature change with time of the object portion to be cooled after the stop of the fan is shown in FIG. 9. In FIG. 9, "Ta" represents the phase transition (change) temperature of the phase transition material. "A" represents the case where the heat-absorbing member is provided at one position on the frame and "B" represents the case where the heat-absorbing member having the same size as that in the case of "A" is divided into a plurality of (two in this case) heat-absorbing members, which are then separately attached to the front and rear sides of the frame. The temperature of the object portion to be cooled is increased from a time t at which the cooling fan is stopped but the temperature rise of the object portion (member) to be cooled can be suppressed by attaching the heat-absorbing member to the frame thereby to absorb heat quantity Q from the heat transfer medium. Further, even when the heat-absorbing members having the same size are used, by dividing one of the heat-absorbing members into the plurality of heat-absorbing members and then separately attaching the divided heat-absorbing members to the front and rear sides of the heat transfer medium, the resultant heat absorption efficiency is increased. When the temperature reaches its peak, the temperature in the apparatus is then decreased gradually by a difference in temperature from an ambient temperature. When the temperature is below the phase transition (change) temperature, the phase transition material is solidified again. The phase transition material is reusable by being repetitively subjected to the above-described cycle.

As described above, the temperature rise of the object portion to be cooled after the main switch 100 is turned off to stop the cooling fan in a state in which the inside temperature of the apparatus is sufficiently high during the operation of the image forming apparatus can be efficiently suppressed in a saved space by attaching the heat-absorbing member to the front and rear sides of the heat transfer medium.

In this embodiment, on the heat transfer medium in the heat transfer path from the heat source to the object portion to be cooled, the plurality of the phase transition material is attached to front and rear flat surface portions of the heat transfer medium so that a flat surface portion of each of the phase transition material-containing containers intimately contacts the associated flat surface portion of the heat transfer medium. As a result, the heat absorption efficiency from the heat transfer medium can be increased, so that the temperature rise of the toner feeding path and the toner container which are the object portion to be cooled can be efficiently suppressed.

Therefore, even in the case where a space in which the heat insulating member can achieve a sufficient temperature rise suppression effect cannot be ensured in the apparatus, the temperature rise of the object portion to be cooled can be suppressed so that the temperature is not more than a predetermined temperature without actuating the cooling fan after the main switch-off. Further, by directly attaching the heat-absorbing member to the heat transfer medium, the heat transfer member is not needed, so that it is possible to realize the image forming apparatus with saved space and low cost.

In the above-described embodiments, the image forming apparatus using the rotary developing apparatus is described as an example but the present invention is not limited thereto.

For example, the image forming apparatus according to the present invention may also be of a so-called tandem type wherein image forming stations are disposed in parallel with each other. Further, the image forming apparatus is not limited to the color image forming apparatus but may also be a monochromatic image forming apparatus.

While the invention has been described with reference to the structures disclosed herein, it is not confined to the details set forth and this application is intended to cover such modifications or changes as may come within the purposes of the improvements or the scope of the following claims.

This application claims priority from Japanese Patent Application No. 153344/2008 filed Jun. 11, 2008, which is hereby incorporated by reference.

What is claimed is:

1. An image forming apparatus comprising:

a toner image forming device configured to form a toner image on a sheet using toner, said toner image forming device having a toner containing portion configured to contain the toner;

an image heating device configured to heat the toner image on the sheet;

a fan configured to flow air in an air flow path between said toner containing portion and said image heating device; and a phase transition material, disposed at a position closer to said toner containing portion than said image heating device with respect to said air flow path, configured to cool said toner containing portion with a phase transition from a solid phase to a liquid phase when said fan is stopped.

2. The image forming apparatus according to claim 1, wherein said phase transition material is maintained in a state of the solid phase when said fan is operated, and wherein said phase transition material transitions from the solid phase to the liquid phase at a temperature which is not higher than a glass transition temperature of the toner.

3. The image forming apparatus according to claim 2, further comprising a heat-insulating cover configured to heat-insulate between said image heating device and said toner containing portion.

4. The image forming apparatus according to claim 3, wherein said air flow path is disposed at a position between said heat-insulating cover and said image heating device.

5. The image forming apparatus according to claim 1, further comprising a container configured to hermetically contain the phase transition material.

6. The image forming apparatus according to claim 1, wherein said toner containing portion includes a developing device configured to develop an electrostatic image on an image bearing member using the toner.

7. The image forming apparatus according to claim 1, wherein said toner image forming device includes a developing device configured to develop an electrostatic image on an image bearing member using the toner, and wherein said toner containing portion includes a toner supply container, which is detachably mountable to said image forming apparatus, configured to supply the toner to said developing device.

8. The image forming apparatus according to claim 1, wherein said toner image forming device includes:

a developing device configured to develop an electrostatic image on an image bearing member using the toner, and a toner supply container, detachably mountable to said image forming apparatus, configured to supply the toner to said developing device, and wherein said toner containing portion includes a toner feeding pipe configured to feed the toner supplied from said toner supply container to said developing device.

* * * * *